US011370240B2

(12) United States Patent
Kinoshita et al.

(10) Patent No.: US 11,370,240 B2
(45) Date of Patent: Jun. 28, 2022

(54) RECORDING MATERIAL AND RECORDING SHEET

(71) Applicant: NIPPON SODA CO., LTD., Tokyo (JP)

(72) Inventors: Shuntaro Kinoshita, Chiba (JP); Kayoko Tada, Chiba (JP); Hiroshi Sakai, Chiba (JP); Kazumi Hamakawa, Chiba (JP)

(73) Assignee: NIPPON SODA CO., LTD., Tokyo (JP)

( * ) Notice: Subject to any disclaimer, the term of this patent is extended or adjusted under 35 U.S.C. 154(b) by 394 days.

(21) Appl. No.: 16/478,161

(22) PCT Filed: Jan. 24, 2018

(86) PCT No.: PCT/JP2018/002110
§ 371 (c)(1),
(2) Date: Jul. 16, 2019

(87) PCT Pub. No.: WO2018/139484
PCT Pub. Date: Aug. 2, 2018

(65) Prior Publication Data

US 2019/0381820 A1 Dec. 19, 2019

(30) Foreign Application Priority Data

Jan. 30, 2017 (JP) ..... JP2017-013813

(51) Int. Cl.

| | |
|---|---|
| ***B41M 5/333*** | (2006.01) |
| ***B41M 5/337*** | (2006.01) |
| ***B41M 5/50*** | (2006.01) |
| ***B41M 5/323*** | (2006.01) |
| *B41M 5/327* | (2006.01) |

(52) U.S. Cl.
CPC ..... *B41M 5/3333* (2013.01); *B41M 5/323* (2013.01); *B41M 5/3375* (2013.01); *B41M 5/502* (2013.01); *B41M 5/3275* (2013.01); *B41M 2205/04* (2013.01)

(58) Field of Classification Search
CPC .. B41M 5/323; B41M 5/3275; B41M 5/3333; B41M 5/3336; B41M 5/3375; B41M 2205/04
See application file for complete search history.

(56) References Cited

U.S. PATENT DOCUMENTS

| | | | | |
|---|---|---|---|---|
| 7,635,662 | B2 | 12/2009 | Kabashima et al. | |
| 10,850,546 | B2 * | 12/2020 | Boxhammer | B41M 5/323 |
| 2004/0029056 | A1 | 2/2004 | Tsukada | |
| 2012/0004349 | A1 | 1/2012 | Kaneko et al. | |
| 2014/0231529 | A1 | 8/2014 | Fisher et al. | |
| 2018/0022137 | A1 | 1/2018 | Kinoshita et al. | |
| 2020/0039271 | A1 * | 2/2020 | Boxhammer | B41M 5/42 |

FOREIGN PATENT DOCUMENTS

| | | | | |
|---|---|---|---|---|
| JP | H02-235682 | A | 9/1990 | |
| JP | H06-191154 | A | 7/1994 | |
| JP | 2002-274058 | A | 9/2002 | |
| JP | 2004-322617 | A | 11/2004 | |
| JP | 2007-216512 | A | 8/2007 | |
| JP | 2017-52175 | A | 3/2017 | |
| WO | 2000/35679 | A1 | 6/2000 | |
| WO | 2010/103809 | A1 | 9/2010 | |
| WO | 2014/143174 | A1 | 9/2014 | |
| WO | 2016/125460 | A1 | 8/2016 | |
| WO | WO-2018065328 | A1 * | 4/2018 | B41M 5/323 |

OTHER PUBLICATIONS

Jan. 18, 2021 Office Action issued in Korean Patent Application No. 10-2019-7021102 (English translation).

* cited by examiner

*Primary Examiner* — Gerard Higgins
(74) *Attorney, Agent, or Firm* — Oliff PLC

(57) ABSTRACT

A recording material and a recording sheet having better color-developing performance, storage stability, etc. A recording material which contains (A) at least one color former, (B) at least one compound selected from the group including compounds represented by the following formula (I), and (C) at least one compound selected from the group including compounds represented by the following formula (II)
(wherein $R^1$ to $R^3$ each represent a halogen atom, a nitro group, a $C_1$ to $C_6$ alkyl group, a $C_1$ to $C_6$ alkoxy group, a $C_2$ to $C_6$ alkenyl group or a $C_1$ to $C_6$ haloalkyl group, n1 and n3 each independently represent any integer of 0 to 5, n2 represents any integer of 0 to 4, and X represents —$SO_2$—O— or —O—$SO_2$—).

(I)

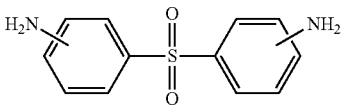

(II)

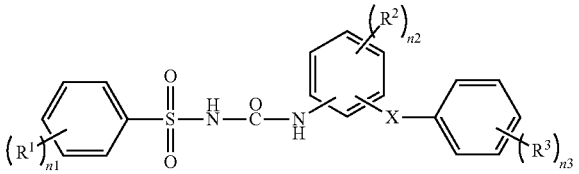

6 Claims, No Drawings

RECORDING MATERIAL AND RECORDING SHEET

TECHNICAL FIELD

The present invention relates to a recording material employing color development through a reaction between a color former and a color-developing agent, and a recording sheet using the recording material. The present application claims priority of Japanese Patent Application No. 2017-013813 filed on Jan. 30, 2017, the content of which is incorporated herein by reference.

BACKGROUND ART

The recording material employing color development through a reaction between a color former and a color-developing agent, since record may be made by a relatively simple apparatus in a short time without applying a complicated treatment such as development and fixation, are widely used in e.g., thermal recording paper for output-recording from a facsimile, a printer or the like, or pressure-sensitive copying paper of a ledger sheet for simultaneous copying to several sheets. As these recording materials, materials quickly developing color and keeping whiteness of uncolored part (hereinafter referred to as "background") and providing highly robust colored images are desired, however, in view of long-term storage stability, a recording material providing background and images having excellent heat resistance are particularly desired. To attain this, it has been desired to develop a color former, a color-developing agent, a storage stabilizer and the like and thereby obtain a recording material having a further well-balanced color-developing sensitivity, background and image storage stability, etc.

In Patent Document 1, a recording material is described, in which 4,4'-diaminodiphenyl sulfone or 3,3'-diaminodiphenyl sulfone is used as a color-developing agent or used in combination with another color-developing agent or a sensitizer.

In Patent Documents 2 and 3, it is described that, in a recording material containing a color former and a specific color-developing agent, 4,4'-diaminodiphenyl sulfone in Patent Document 2 and 3,3'-diaminodiphenyl sulfone in Patent Document 3 are further used in combination. In Patent Document 3, it is described that a combination with a specific non-phenolic sulfonylurea color-developing agent provides good oil resistance. Oil resistance is a property originally possessed by the color-developing agent.

In Patent Document 4 and the like, it is described that a recording material in which a specific non-phenolic sulfonylurea compound is used as a color-developing agent has excellent background whiteness and image stability.

PRIOR ART DOCUMENTS

Patent Documents

Patent Document 1: WO 2014/143174

Patent Document 2: Japanese unexamined Patent Application Publication No. H2-235682

Patent Document 3: Japanese unexamined Patent Application Publication No. H6-191154

Patent Document 4: WO 2000/35679

SUMMARY OF INVENTION

Object to be Solved by the Invention

An object of the present invention is to provide a recording material and recording sheet having better color-developing performance, storage stability, etc.

Means to Solve the Object

The present inventors have conducted studies on additives suitably used in combination with a non-phenolic color-developing agent. During the period, they found that when a diaminodiphenyl sulfone compound is used as an additive with a specific non-phenolic sulfonylurea color-developing agent, the storage stability is particularly good. Based on the finding, the present invention has been completed.

More specifically, the present invention relates to, (1) A recording material comprising (A) at least one color former, (B) at least one compound selected from the group consisting of compounds represented by the following formula (I):

(I)

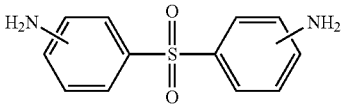

and (C) at least one compound selected from the group consisting of compounds represented by the following formula (II):

(II)

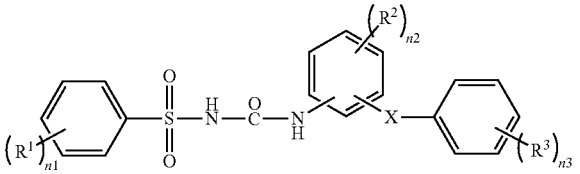

(wherein $R^1$ to $R^3$ each represent a halogen atom, a nitro group, a $C_1$ to $C_6$ alkyl group, a $C_1$ to $C_6$ alkoxy group, a $C_2$ to $C_6$ alkenyl group or a $C_1$ to $C_6$ haloalkyl group, n1 and n3 each independently represent any integer of 0 to 5, n2 represents any integer of 0 to 4, and X represents —$SO_2$—O— or —O—$SO_2$—);

(2) The recording material according to (1), wherein the compound represented by the above formula (I) is at least one compound selected from 4,4'-diaminodiphenyl sulfone and 3,3'-diaminodiphenyl sulfone;

(3) The recording material according to (1) or (2), wherein the compound represented by the above formula (II) is a compound represented by the following formula (III):

(III)

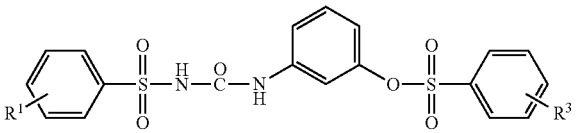

(wherein $R^1$ and $R^3$ are the same as $R^1$ and $R^3$ in formula (II));

(4) The recording material according to (3), wherein the compound represented by the formula (III) is N-(p-toluenesulfonyl)-N'-(3-p-toluenesulfonyloxyphenyl)urea;

(5) The recording material according to any one of (1) to (4), wherein the color former is a fluoran-based dye; and (6) A recording sheet having a recording material layer formed from the recording material according to any one of (1) to (5) on a support.

Effect of the Invention

According to the present invention, it is possible to obtain a recording material and a recording sheet having good color-developing performance and storage stability. In particular, it is possible to obtain a recording material having excellent plasticizer resistance, oil resistance, and heat resistance of colored images.

Mode of Carrying Out the Invention (Recording Material)

The recording material of the present invention is a recording material employing color development through a reaction between a color former and a color-developing agent and containing at least a color former (A), a compound represented by the above formula (I) (B), and a compound represented by the above formula (II) (C).

The recording material of the present invention may be applied to any use, for example, thermal recording materials or pressure sensitive copying materials. In particular, the recording material is preferably applied to thermal recording materials.

(Component (A))

As a color former, which is Component (A) to be used in the recording material of the present invention, a leuco dye such as a fluoran dye, a phthalide dye, a lactam dye, a triphenylmethane dye, a phenothiazine dye, a spiropyran dye or the like may be exemplified, however, the color former is not limited to these. Any color former may be used as long as it develops color by being in contact with a color-developing agent as an acid substance. Although these color formers may be used alone to produce a recording material having color specified by the color former beyond any doubt, they may be used by combination of two or more thereof. For example, color formers of three primary colors, red, blue and green or a black color former may be used in combination to produce a recording material developing jet black.

Among them, a fluoran color former may be preferably exemplified.

As the color former, for example, 3,3-bis(p-dimethylaminophenyl)-phthalide, 3,3-bis(p-dimethylaminophenyl)-6-dimethylaminophthalide (also called as crystal violet lactone), 3,3-bis(p-dimethylaminophenyl)-6-diethylaminophthalide, 3,3-bis(p-dimethylaminophenyl)-6-chlorophthalide, 3,3-bis(p-dibutylaminophenyl)-phthalide, 3-cyclohexylamino-6-chlorofluoran, 3-dimethylamino-5,7-dimethylfluoran, 3-N-methyl-N-isopropylamino-6-methyl-7-anilinofluoran, 3-N-methyl-N-isobutylamino-6-methyl-7-anilinofluoran, 3-N-methyl-N-isoamylamino-6-methyl-7-anilinofluoran, 3-diethylamino-7-chlorofluoran, 3-diethylamino-6,8-dimethylfluoran, 3-diethylamino-7-methylfluoran, 3-diethylamino-7,8-benzofluoran, 3-diethylamino-6-methyl-7-chlorofluoran, 3-dibutylamino-6-methyl-7-bromofluoran, 3-(N-p-tolyl-N-ethylamino)-6-methyl-7-anilinofluoran, 3-pyrrolidino-6-methylamino-7-anilinofluoran, 2-{N-(3'-trifluoromethylphenyl)amino}-6-diethylaminofluoran, 2-[3,6-bis(diethylamino)-9-(o-chloroanilino)xanthyl] benzoic acid lactam, 3-diethylamino-6-methyl-7-(m-trichloromethylanilino)fluoran, 3-diethylamino-7-(o-chloroanilino)fluoran, 3-dibutylamino-7-(o-chloroanilino)fluoran, 3-N-methyl-N-amylamino-6-methyl-7-anilinofluoran, 3-N-methyl-N-cyclohexylamino-6-methyl-7-anilinofluoran, 3-diethylamino-6-methyl-7-anilinofluoran, 3-diethylamino-6-methyl-7-(2',4'-dimethylanilino)fluoran, 3-(N,N-diethylamino)-5-methyl-7-(N,N-dibenzylamino)fluoran, 3-(N,N-diethylamino)-7-(N,N-dibenzylamino)fluoran, 3-(N-ethyl-N-isobutylamino)-6-methyl-7-anilinofluoran, 3-(N-ethyl-N-propylamino)-6-methyl-7-anilinofluoran, 3-(N-methyl-N-propylamino)-6-methyl-7-anilinofluoran, 3-(N-ethyl-N-isopentylamino)-6-methyl-7-anilinofluoran, 3-(N-ethyl-N-toluidino)-6-methyl-7-anilino-fluoran, 3-pyrrolidino-6-methyl-7-anilinofluoran, 3-piperidino-6-methyl-7-anilinofluoran, 3-dimethylamino-7-(m-trifluoromethylanilino)fluoran, 3-dipentylamino-6-methyl-7-anilinofluoran, 3-(N-ethoxypropyl-N-ethylamino)-6-methyl-7-anilinofluoran, 3-dibutylamino-7-(o-fluoroanilino)fluoran, 3-diethylaminobenzo[a]fluoran, 3-diethylamino-5-methyl-7-benzylaminofluoran, 3-diethylamino-5-chlorofluoran, 3-diethylamino-6-(N,N'-dibenzylamino)fluoran, 3,6-dimethoxyfluoran, 2,4-dimethyl-6-(4-dimethylaminophenyl)aminofluoran, 3-diethylamino-7-(m-trifluoromethylanilino)fluoran, 3-diethylamino-6-methyl-7-octylaminofluoran, 3-diethylamnino-6-methyl-7-(m-tolylamnino)fluoran, 3-diethylamino-6-methyl-7-(2,4-xylylamino)fluoran, 3-diethylamino-7-(o-fluoroanilino)fluoran, 3-diphenylamino-6-methyl-7-anilinofluoran, benzoylleucomethylene blue, 6'-chloro-8'-methoxy-benzoindolino-spiropyran, 6'-bromo-3'-methoxy-benzoindolino-spiropyran, 3-(2'-hydroxy-4'-dimethylaminophenyl)-3-(2'-methoxy-5'-chlorophenyl)phthalide, 3-(2-hydroxy-4'-dimethylaminophenyl)-3-(2'-methoxy-5'-nitrophenyl) phthalide, 3-(2'-hydroxy-4'-diethylaminophenyl)-3-(2'-methoxy-5'-methylphenyl)phthalide, 3-(2'-methoxy-4'-dimethylaminophenyl)-3-(2'-hydroxy-4'-chloro-5'-methylphenyl)phthalide, 3-morpholino-7-(N-propyl-trifluoromethylanilino)fluoran, 3-pyrrolidino-7-trifluoromethylanilinofluoran, 3-diethylamino-5-chloro-7-(N-benzyl-trifluoromethylanilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-piperidinofluoran, 2-chloro-3-(N-methyl-toluidino)-7-(p-n-butylanilino)fluoran, 3-(N-methyl-N-isopropylamino)-6-methyl-7-anilinofluoran, 3-dibutylamino-6-methyl-7-anilinofluoran, 3-dipentylamino-6-methyl-7-anilinofluoran, 3,6-bis(dimethylamino)fluorenespiro(9,3')-

6'-dimethylaminophthalide, 3-(N-benzyl-N-cyclohexylamino)-5,6-benzo-7-α-naphthylamino-4'-bromofluoran, 3-diethylamino-6-chloro-7-anilinofluoran, 3-N-ethyl-N-(2-ethoxypropyl)amino-6-methyl-7-anilinofluoran, 3-N-ethyl-N-tetrahydrofurfurylamino-6-methyl-7-anilinofluoran, 3-diethylamino-6-methyl-7-mesitydino-4',5'-benzofluoran, or 3-(N-ethyl-p-toluidino)-7-(methylphenylamino)fluoran may be exemplified.

Among these color formers, 3-cyclohexylamino-6-chlorofluoran, 3-diethylamino-7-chlorofluoran, 3-diethylamino-6,8-dimethylfluoran, 3-diethylamino-7-methylfluoran, 3-diethylamino-7,8-benzofluoran, 3-diethylamino-6-methyl-7-chlorofluoran, 3-dibutylamino-6-methyl-7-bromofluoran, 3-diethylamino-7-(o-chloroanilino)fluoran, 3-dibutylamino-7-(o-chloroanilino)fluoran, 3-N-methyl-N-cyclohexylamino-6-methyl-7-anilinofluoran, 3-(N,N-diethylamino)-5-methyl-7-(N,N-dibenzylamino)fluoran, 3-(N,N-diethylamino)-7-(N,N-dibenzylamino)fluoran, 3-(N-ethyl-N-isobutylamino)-6-methyl-7-anilinofluoran, 3-(N-methyl-N-propylamino)-6-methyl-7-anilinofluoran, 3-(N-ethyl-N-isopentylamino)-6-methyl-7-anilinofluoran, 3-(N-ethyl-N-toluidino)-6-methyl-7-anilinofluoran, 3-(N-ethoxypropyl-N-ethylamino)-6-methyl-7-anilinofluoran, 3-dibutylamino-7-(o-fluoroanilino)fluoran, 3-diethylamino-7-(m-trifluoromethylanilino)fluoran, 3-diethylamino-6-methyl-7-octylaminofluoran, 3-diethylamino-6-methyl-7-(m-tolylamino)fluoran, 3-diethylamino-7-(o-fluoroanilino)fluoran, 3-diphenylamino-6-methyl-7-anilinofluoran, 3-dibutylamino-6-methyl-7-anilinofluoran, 3-N-ethyl-N-tetrahydrofurfurylamino-6-methyl-7-anilinofluoran, 3-(N-ethyl-p-toluidino)-7-(methylphenylamino)fluoran or the like may be particularly preferably exemplified.

As a near infrared absorbing dye, 3-[4-[4-(4-anilino)-anilino]anilino]-6-methyl-7-chlorofluoran, 3,3-bis[2-(4-dimethylaminophenyl)-2-(4-methoxyphenyl)vinyl]-4,5,6,7-tetrachlorophthalide, 3,6,6'-tris(dimethylamino)spiro(fluorene-9,3'-phthalide) or the like may be exemplified.

(Component (B))

Component (B), which is an additive to be used in the recording material of the present invention, is a compound represented by formula (I):

(I)

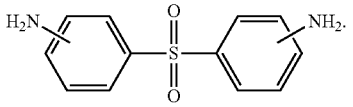

It is known that at least some compounds of component (B) function as a color-developing agent which reacts with component (A) when used alone and function as a storage stabilizer or sensitizer in the recording sheet when used in combination with a specific color-developing agent. In the present invention, component (B), when used in combination with component (C) as the color-developing agent, improves the color-developing function.

In the above formula (I), two amino groups are each present as a substituent in any one of the 2 to 4 position of different benzene rings. The specific position thereof may be any one of the 2,2' position, 2,3' position, 2,4' position, 3,3' position, 3,4' position, and 4,4' position. Component (B) may also be a mixture formed of a plurality of these compounds.

Among them, it is preferred to be at least one selected from 4,4'-diaminodiphenyl sulfone and 3,3'-diphenyl sulfone, and 4,4'-diaminodiphenyl sulfone is particularly preferable.

(Component (C))

Component (C) to be used in the recording material of the present invention is a color-developing agent which is at least one compound selected from compounds represented by formula (II):

(II)

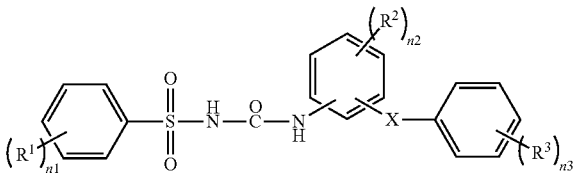

In formula (II), as $R^1$ to $R^3$, a halogen atom; a nitro group; a $C_1$ to $C_6$ alkyl group; a $C_1$ to $C_6$ alkoxy group; a $C_2$ to $C_6$ alkenyl group; a $C_1$ to $C_6$ fluoro alkyl group can be exemplified.

n1 and n3 each independently represent any integer of 0 to 5, and n2 represents any integer of 0 to 4.

X represents —$SO_2$—O— or —O—$SO_2$—.

As $R^1$ and $R^3$, a linear $C_1$ to $C_6$ alkyl group is preferred, and a methyl group is further preferred. Also preferably, n1 and n3 each represent 1, and n2 is 0.

As a compound represented by formula (II), a compound represented by formula (III):

(III)

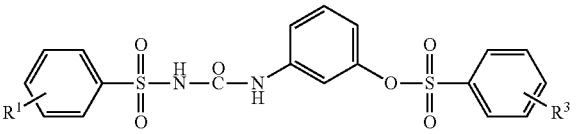

is particularly preferred.

In formula (III), $R^1$ and $R^3$ are the same as $R^1$ and $R^3$ in formula (II).

As a compound represented by formula (III), N-(p-toluenesulfonyl)-N'-(3-p-toluenesulfonyloxyphenyl) urea is further preferred, which is commercially available as PF-201 (manufactured by BASF SE).

In the above, as the halogen atom, a fluorine atom, a chlorine atom, a bromine atom, an iodine atom or the like may be exemplified. As the $C_1$ to $C_6$ alkyl group, for example, a methyl group, an ethyl group, a n-propyl group, an i-propyl group, a n-butyl group, an s-butyl group, an i-butyl group, a t-butyl group, a n-pentyl group or n-hexyl group may be exemplified. As the $C_1$ to $C_6$ alkoxy group, for example, a methoxy group, an ethoxy group, a n-propoxy group, an i-propoxy group, a n-butoxy group, an s-butoxy group, an i-butoxy group or a t-butoxy group may be exemplified. As the $C_2$ to $C_6$ alkenyl group, for example, a vinyl group, a 1-propenyl group, a 2-propenyl group, a 1-butenyl group, a 2-butenyl group, a 3-butenyl group, a 1-methyl-2-propenyl group, a 2-methyl-2-propenyl group, a 1-pentenyl group, a 2-pentenyl group, a 3-pentenyl group, a 4-pentenyl group, a 1-methyl-2-butenyl group, a 2-methyl-2-butenyl group, a 1-hexenyl group, a 2-hexenyl group, a 3-hexenyl group, a 4-hexenyl group or a 5-hexenyl group may be exemplified. As the $C_1$ to $C_6$ haloalkyl group, which is an alkyl group substituted by a halogen atom, for example, a chloromethyl group, a bromomethyl group, a fluoromethyl group, a trifluoromethyl group, a trichloromethyl group, a tribromomethyl group, a 2,2,2-trichloroethyl group, a 2,2,3,3,3-pentafluoropropyl group or a 1-chlorobutyl group, a 6-fluorohexyl group, a 6,6,6-trifluorohexyl group may be exemplified.

In the recording material of the present invention, the ratio of component (C) to be used is usually 0.01 to 10 parts by mass, preferably 0.5 to 10 parts by mass, preferably 1 to 5 parts by mass, and more preferably 1.5 to 4 parts by mass, with respect to 1 part by mass of the color former.

Component (C) is preferably contained in the range of 3 to 35% by mass and more preferably in the range of 10 to 25% by mass, with respect to the total solids mass forming the thermal layer.

In the recording material of the present invention, the ratio of component (B) to be used is usually 0.01 to 5 parts by mass, preferably 0.1 to 1 parts by mass, and more preferably 0.15 to 0.5 parts by mass, with respect to 1 part by mass of component (C).

(Other Components in the Recording Material)

In the recording material of the present invention, other than each of components (A), (B), and (C), one or more agents known in the art such as a color-developing agent, a sensitizer, an image stabilizer, a filler, a dispersant, an antioxidant, an anti-adhesive agent, a defoaming agent, a light stabilizer, and a fluorescent whitening agent known in the art may be contained as necessary. The amount of each of the components except the color former relative to the color former (1 part by mass) usually falls within the range of 0.1 to 15 parts by mass and preferably 1 to 10 parts by mass.

These chemical agents may be contained in a color developing layer. In case of a multi-layer structure, more specifically, in case where the color developing layer has an overcoat layer and/or an undercoat layer on and/or under the color forming layer, these chemical agents may be contained in these layers. Furthermore, if necessary, an antioxidant and a light stabilizer may be encapsulated in microcapsules and then added to these layers.

As the specific examples of the different type of color-developing agents, the following ones may be exemplified.

A bisphenol compound such as bisphenol A, 4,4'-sec-butylidenebisphenol, 4,4'-cyclohexylidenebisphenol, 2,2'-bis(4-hydroxyphenyl)-3,3'-dimethylbutane, 2,2'-dihydroxydiphenyl, pentamethylene-bis(4-hydroxybenzoate), 2,2-dimethyl-3,3-di(4-hydroxyphenyl)pentane, 2,2-bis(4-hydroxyphenyl)hexane, 2,2-bis(4-hydroxyphenyl)propane, 2,2-bis(4-hydroxyphenyl)butane, 2,2-bis(4-hydroxy-3-methylphenyl)propane, 4,4'-(1-phenylethylidene)bisphenol, 4,4'-ethylidenebisphenol, 4-(4-hydroxyphenyl)-2-methylphenol, 2,2'-bis(4-hydroxy-3-phenyl-phenyl)propane, 4,4'-(1,3-phenylenediisopropylidene)bisphenol, 4,4'-(1,4-phenylenediisopropylidene)bisphenol, or butyl 2,2-bis(4-hydroxyphenyl)acetate; a sulfur-containing bisphenol compound such as 4,4'-dihydroxydiphenyl thioether, 1,7-di(4-hydroxyphenylthio)-3,5-dioxaheptane, 2,2'-bis(4-hydroxyphenylthio)diethyl ether, or 4,4'-dihydroxy-3,3'-dimethyldiphenyl thioether; a 4-hydroxybenzoic acid ester such as benzyl 4-hydroxybenzoate, ethyl 4-hydroxybenzoate, propyl 4-hydroxybenzoate, isopropyl 4-hydroxybenzoate, butyl 4-hydroxybenzoate, isobutyl 4-hydroxybenzoate, 4-chlorobenzyl 4-hydroxybenzoate, 4-methylbenzyl 4-hydroxybenzoate, or diphenylmethyl 4-hydroxybenzoate; a metal salt of benzoic acid such as zinc benzoate or zinc 4-nitrobenzoate, salicylic acids such as 4-[2-(4-methoxyphenyloxy)ethyloxy]salicylic acid; a metal salt of salicylic acid such as zinc salicylate or zinc bis[4-(octyloxycarbonylamino)-2-hydroxybenzoate]; a hydroxy sulfone such as 4,4'-dihydroxydiphenyl sulfone, 2,4'-dihydroxydiphenyl sulfone, 4-hydroxy-4'-methyldiphenyl sulfone, 4-hydroxy-4'-isopropoxydiphenyl sulfone, 4-hydroxy-4'-butoxydiphenyl sulfone, 4,4'-dihydroxy-3,3'-diallyldiphenyl sulfone, 3,4-dihydroxy-4'-methyldiphenyl sulfone, 4,4'-dihydroxy-3,3',5,5'-tetrabromodiphenyl sulfone, 4-allyloxy-4'-hydroxydiphenyl sulfone, 2-(4-hydroxyphenylsulfonyl)phenol, 4,4'-sulfonylbis[2-(2-propenyl)]phenol, 4-[{4-(propoxy)phenyl}sulfonyl]phenol, 4-[{4-(allyloxy)phenyl}sulfonyl]phenol, 4-[{4-(benzyloxy)phenyl}sulfonyl]phenol, or 2,4-bis(phenylsulfonyl)-5-methyl-phenol; a polyvalent metal salt of a hydroxy sulfone such as a zinc, magnesium, aluminum or titanium salt of 4-phenylsulfonylphenoxy; a 4-hydroxyphthalic acid diester such as dimethyl 4-hydroxyphthalate, dicyclohexyl 4-hydroxyphthalate, or diphenyl 4-hydroxyphthalate; a hydroxynaphthoic acid ester such as 2-hydroxy-6-carboxynaphthalene; a trihalomethylsulfone such as tribromomethylphenylsulfone; hydroxyacetophenone, p-phenylphenol, benzyl 4-hydroxyphenylacetate, p-benzylphenol, hydroquinone-monobenzyl ether, 2,4-dihydroxy-2'-methoxybenzanilide, tetracyanoquinodimethanes, N-(2-hydroxyphenyl)-2-[(4-hydroxyphenyl)thio]acetamide, N-(4-hydroxyphenyl)-2-[(4-hydroxyphenyl)thio]acetamide, 4-hydroxybenzenesulfonanilide, 4'-hydroxy-4-methylbenzenesulfonanilide, 3-(3-phenylureido)benzenesulfonanilide, octadecylphosphoric acid, or dodecylphosphoric acid; a non-phenol sulfonylurea compound such as 4,4'-bis(N-p-tolylsulfonylaminocarbonylamino)diphenylmethane, or 3,3'-bis(p-tolylsulfonylaminocarbonylamino)diphenyl sulfone; a non-phenol compound such as 4,4'-bis[3-(4-methyl-3-phenoxycarbonylaminophenyl)ureido]diphenyl sulfone, N-(2-(3-phenylureido)phenyl)benzenesulfonamide, 3-(3-phenylureido)benzenesulfonamide, zinc bis[4-(n-octyloxycarbonylamino)salicylate]dihydrate, zinc 4-[2-(4-methoxyphenoxy)ethoxy]salicylate, or zinc 3,5-bis(α-methylbenzyl)salicylate; or a diphenyl sulfone crosslinked compound represented by the following formula or a mixture thereof or the like may be exemplified.

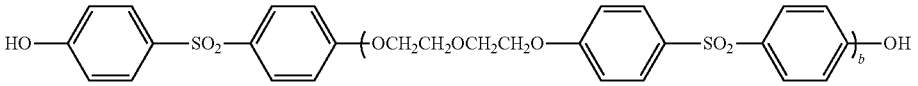

(b is an integer of 0 to 6.)

Isocyanate compounds described in Patent Document 4 and the like also have a function of reacting with a color former having amino groups to develop colors. However, it is preferred that these compounds be not contained in the recording material of the present invention because of having safety concerns.

In the recording material of the present invention, the ratio of another color-developing agent to be used is 0.01 to 10 parts by mass, and more preferably 0.5 to 10 parts by mass, with respect to 1 part by mass of the color former.

As the specific examples of the sensitizer, the following ones may be exemplified.

A higher fatty acid amide such as stearic acid amide, stearic acid anilide, or palmitic acid amide; an amide such as benzamide, acetoacetanilide, thioacetanilide, acrylic acid amide, ethylenebisamide, ortho-toluenesulfonamide or para-toluenesulfonamide; a phthalic acid diester such as dimethyl phthalate, dibenzyl isophthalate, dimethyl isophthalate, dimethyl terephthalate, diethyl isophthalate, diphenyl isophthalate, or dibenzyl terephthalate; an oxalic acid diester such as dibenzyl oxalate, di(4-methylbenzyl) oxalate, di(4-chlorobenzyl) oxalate, a mixture of dibenzyl oxalate and di(4-chlorobenzyl) oxalate in equal amounts, or a mixture of di(4-chlorobenzyl) oxalate and di(4-methylbenzyl) oxalate in equal amounts; a bis(t-butylphenol) such as 2,2'-methylenebis(4-methyl-6-t-butylphenol) or 4,4'-methylene-bis(2,6-di-t-butylphenol); 1,2-bis(phenoxy) ethane (abbreviation: EGPE), 1,2-bis(4-methylphenoxy) ethane, 1,2-bis(3-methylphenoxy) ethane, 1,2-bis(phenoxymethyl)benzene, 1,2-bis(4-methoxyphenylthio) ethane, 1,2-bis(4-methoxyphenoxy) propane, 1,3-phenoxy-2-propanol, 1,4-diphenylthio-2-butene, 1,4-diphenylthiobutane, 1,4-diphenoxy-2-butene, 1,5-bis(4-methoxyphenoxy)-3-oxapentane, 1,3-dibenzoyloxypropane, dibenzoyloxymethane, 4,4'-ethylenedioxy-bisbenzoic acid dibenzyl ester, bis[2-(4-methoxy-phenoxy) ethyl] ether, 2-naphthylbenzyl ether, 1,3-bis(2-vinyloxyethoxy)benzene, 1,4-diethoxynaphthalene, 1,4-dibenzyloxynaphthalene, 1,4-dimethoxynaphthalene, 1,4-bis(2-vinyloxyethoxy)benzene, p-(2-vinyloxyethoxy) biphenyl, p-allyloxybiphenyl, p-propargyloxybiphenyl, p-benzyloxybenzyl alcohol, 4-(m-methylphenoxymethyl)biphenyl, (4-methylphenyl)phenyl ether, N,N'-di(2-naphthyl)-1,4-phenylenediamine, diphenylamine, carbazole, 2,3-di-m-tolylbutane, 4-benzylbiphenyl, or 4,4'-dimethylbiphenyl; a terphenyl such as m-terphenyl or p-terphenyl; 1,2-bis(3,4-dimethylphenyl)ethane, 2,3,5,6-tetramethyl-4'-methyldiphenylmethane, 4-acetylbiphenyl, dibenzoylmethane, triphenylmethane, phenyl 1-hydroxy-2-naphthoate, methyl 1-hydroxy-2-naphthoate, N-octadecylcarbamoyl-p-methoxycarbonylbenzene, benzyl p-benzyloxybenzoate, phenyl β-naphthoate, methyl p-nitrobenzoate, or diphenyl sulfone; a carbonic acid derivative such as diphenyl carbonate, guaiacol carbonate, di-p-tolyl carbonate, or phenyl-α-naphthyl carbonate; an aromatic alcohol such as p-(benzyloxy)benzyl alcohol, 1,3-diphenoxy-2-propanol, 1,1-diphenylpropanol, 1,1-diphenylethanol, benzhydrol, 2-methylbenzhydrol, 4-methylbenzhydrol, or 4,4'-dimethylbenzhydrol; N-octadecylcarbamoylbenzene, dibenzyl disulfide, stearic acid, amide AP-1 (a mixture of stearic acid amide and palmitic acid amide in a ratio of 7:3); a stearate such as aluminum stearate, calcium stearate, or zinc stearate; zinc palmitate, behenic acid, zinc behenate, montanic acid wax, polyethylene wax or the like may be exemplified.

The image heat resistance and the like of the recording sheet may be slightly inferior depending on the type of sensitizer, but in the recording sheet of the present invention, such a problem may be solved by further using a compound represented by formula (I) in combination.

The amount of the sensitizer to be used is preferably in the range of 1 to 40% by mass, more preferably in the range of 5 to 25% by mass, and further preferably in the range of 8 to 20% by mass, of the total solids amount of the thermal recording layer.

As the image stabilizer, for example, epoxy group-containing diphenylsulfones such as 4-benzyloxy-4'-(2-methylglycidyloxy)-diphenylsulfone, and 4,4'-diglycidyloxydiphenylsulfone; 1,4-diglycidyloxybenzene, 4-[α-(hydroxymethyl)benzyloxy]-4'-hydroxydiphenylsulfone, 2-propanol derivatives, salicylic acid derivatives, metal salts of oxynaphthoic acid derivatives (particularly a zinc salts), metal salts of (2,2-methylenebis(4,6-di(t-butyl)phenyl)) phosphate, water-insoluble zinc compounds other than the above zinc compounds; hindered phenol compounds such as 2,2-bis(4'-hydroxy-3',5'-dibromophenyl)propane, 4,4'-sulfonylbis(2,6-dibromophenol), 4,4'-butylidene (6-t-butyl-3-methylphenol), 2,2'-methylene-bis(4-methyl-6-t-butylphenol), 2,2'-methylene-bis(4-ethyl-6-t-butylphenol), 2,2'-di-t-butyl-5,5'-dimethyl-4,4'-sulfonyldiphenol, 1,1,3-tris(2-methyl-4-hydroxy-5-cyclohexylphenyl)butane or 1,1,3-tris (2-methyl-4-hydroxy-5-t-butylphenyl)butane; phenol novolak compounds, epoxy resins, or UU (manufactured by CHEMIPRO KASEI) may be exemplified.

Note that, the image stabilizer is preferably a compound being solid at normal temperature and particularly preferably a compound having a melting point of 60° C. or more and being less soluble in water.

The image stabilizer is preferably used in the range of 0.2 to 0.5 parts by mass, with respect to 1 part by mass of component (C).

The image stabilizer is used preferably in the range of 1 to 30% by mass and more preferably in the range of 5 to 20% by mass, of the total solids amount of the thermal recording layer.

As the filler, for example, silica, clay, kaolin, calcined kaolin, talc, satin white, aluminum hydroxide, calcium carbonate, magnesium carbonate, zinc oxide, titanium oxide, barium sulfate, magnesium silicate, aluminum silicate, plastic pigment, diatomaceous earth, talc or aluminum hydroxide may be exemplified. Among these, calcined kaolin or calcium carbonate may be suitably exemplified. The ratio of the filler to be used is 0.1 to 15 parts by mass relative to the color former (1 part by mass) and preferably 1 to 10 parts by mass. Alternatively, the above fillers may be used as a mixture.

The filler is used preferably at 50% by mass or less, and more preferably at 30% by mass or less, of the total solids amount of the thermal recording layer.

As the dispersant, for example, polyvinyl alcohol; a polyvinyl alcohol such as acetoacetylated polyvinyl alcohol, carboxy modified polyvinyl alcohol, sulfonic acid modified polyvinyl alcohol, amide modified polyvinyl alcohol, butyral modified polyvinyl alcohol, which differs in saponification degree and polymerization degree; cellulose derivatives such as methylcellulose, carboxymethylcellulose, hydroxyethylcellulose, ethylcellulose, acetylcellulose and hydroxymethylcellulose: sodium polyacrylate; polyacrylic acid ester; polyacrylamide; starch; sulfosuccinate esters such as dioctyl sodium sulfosuccinate; sodium dodecylbenzene sulfonate; sodium salts of lauryl alcohol sulfuric acid ester; fatty acid salt; styrene-maleic anhydride copolymers; styrene-butadiene copolymers; polyvinyl chloride, polyvinyl acetate, polyacrylic acid ester, polyvinyl butyral, polyurethane, polystyrene and copolymers thereof; polyamide resins; silicone resins; petroleum resins; terpene resins; ketone resins; or coumarone resins may be exemplified.

The dispersant is dissolved in a solvent such as water, an alcohol, a ketone, an ester or a hydrocarbon and then put in use or may be emulsified or dispersed like a paste in water or another solvent and then put in use.

The dispersant is used preferably in the range of 5 to 50% by mass, and more preferably in the range of 10 to 40% by mass, of the total solids amount of the thermal recording layer.

As the antioxidant, for example, 2,2'-methylenebis(4-methyl-6-t-butylphenol), 2,2'-methylenebis(4-ethyl-6-t-butylphenol), 4,4'-butylidenebis(3-methyl-6-t-butylphenol), 4,4'-thiobis(2-t-butyl-5-methylphenol), 1,1,3-tris(2-methyl-4-hydroxy-5-t-butylphenyl)butane, 1,1,3-tris(2-methyl-4-hydroxy-5-cyclohexylphenyl)butane, 4-{4-[1,1-bis(4-hydroxyphenyl)ethyl]-α,α-dimethylbenzyl}phenol, 1,1,3-tris(2-methyl-4-hydroxy-5-cyclohexylphenyl)butane, 2,2'-methylenebis(6-tert-butyl-4-methylphenol), 2,2'-methylenebis(6-tert-butyl-4-ethylphenol), 4,4'-thiobis(6-tert-butyl-3-methylphenol), 1,3,5-tris [{4-(1,1-dimethylethyl)-3-hydroxy-2,6-dimethylphenyl}methyl]-1,3,5-triazine-2,4,6(1H, 3H, 5H)-trione, or 1,3,5-tris[{3,5-bis(1,1-dimethylethyl)-4-hydroxyphenyl}methyl]-1,3,5-triazine-2,4,6 (1H, 3H, 5H)-trione may be exemplified.

As the anti-adhesive agent, for example, stearic acid, zinc stearate, calcium stearate, carnauba wax, paraffin wax or ester wax may be exemplified.

As the antifoaming agent, for example, a higher alcohol based antifoaming agent, a fatty acid ester based antifoaming agent, an oil based antifoaming agent, a silicone based antifoaming agent, a polyether based antifoaming agent, a modified hydrocarbon based antifoaming agent or a paraffin based antifoaming agent may be exemplified.

As the light stabilizer, for example, a UV absorber based on a salicylic acid such as phenyl salicylate, p-t-butylphenyl salicylate, and p-octylphenyl salicylate; a UV absorber based on benzophenone such as 2,4-dihydroxybenzophenone, 2-hydroxy-4-methoxybenzophenone, 2-hydroxy-4-benzyloxybenzophenone, 2-hydroxy-4-octyloxybenzophenone, 2-hydroxy-4-dodecyloxybenzophenone, 2,2'-dihydroxy-4-methoxybenzophenone, 2,2'-dihydroxy-4,4'-dimethoxybenzophenone, 2-hydroxy-4-methoxy-5-sulfobenzophenone, and bis(2-methoxy-4-hydroxy-5-benzoylphenyl) methane: an UV absorber based on benzotriazole such as 2-(2'-hydroxy-5'-methylphenyl)benzotriazole, 2-(2'-hydroxy-5'-t-butylphenyl)benzotriazole, 2-(2'-hydroxy-3',5'-di-t-butylphenyl)benzotriazole, 2-(2'-hydroxy-3'-t-butyl-5'-methylphenyl)-5-chlorobenzotriazole, 2-(2'-hydroxy-3',5'-di-t-butylphenyl)-5-chlorobenzotriazole, 2-(2'-hydroxy-3',5'-di-t-amylphenyl)benzotriazole, 2-(2'-hydroxy-5'-tert-butylphenyl)benzotriazole, 2-(2'-hydroxy-5'-(1", 1", 3", 3"-tetramethylbutyl)phenyl)benzotriazole, 2-[2'-hydroxy-3'-(3", 4", 5", 6"-tetrahydrophthalimidomethyl)-5'-methylphenyl]benzotriazole, 2-(2'-hydroxy-5'-t-octylphenyl)benzotriazole, 2-[2'-hydroxy-3',5'-bis(α,α-dimethylbenzyl)phenyl]-2H-benzotriazole, 2-(2'-hydroxy-3'-dodecyl-5'-methylphenyl)benzotriazole, 2-(2'-hydroxy-3'-undecyl-5'-methylphenyl)benzotriazole, 2-(2'-hydroxy-3'-tridecyl-5'-methylphenyl)benzotriazole, 2-(2'-hydroxy-3'-tetradecyl-5'-methylphenyl)benzotriazole, 2-(2'-hydroxy-3'-pentadecyl-5'-methylphenyl)benzotriazole, 2-(2'-hydroxy-3'-hexadecyl-5'-methylphenyl)benzotriazole, 2-[2'-hydroxy-4'-(2"-ethylhexyl)oxyphenyl]benzotriazole, 2-[2'-hydroxy-4'-(2"-ethylheptyl)oxyphenyl]benzotriazole, 2-[2'-hydroxy-4'-(2"-ethyloctyl)oxyphenyl]benzotriazole, 2-[2'-hydroxy-4'-(2"-propyloctyl)oxyphenyl]benzotriazole, 2-[2'-hydroxy-4'-(2"-propylheptyl)oxyphenyl]benzotriazole, 2-[2'-hydroxy-4'-(2"-propylhexyl)oxyphenyl]benzotriazole, 2-[2'-hydroxy-4'-(1"-ethylhexyl)oxyphenyl]benzotriazole, 2-[2'-hydroxy-4'-(1"-ethylheptyl)oxyphenyl]benzotriazole, 2-[2'-hydroxy-4'-(1'-ethyloctyl)oxyphenyl]benzotriazole, 2-[2'-hydroxy-4'-(1"-propyloctyl)oxyphenyl]benzotriazole, 2-[2'-hydroxy-4'-(1"-propylheptyl)oxyphenyl]benzotriazole, 2-[2'-hydroxy-4'-(1"-propylhexyl)oxyphenyl]benzotriazole, 2,2'-methylenebis[4-(1,1,3,3-tetramethylbutyl)-6-(2H-benzotriazol-2-yl)]phenol, and a condensation product between polyethylene glycol and methyl-3-[3-t-butyl-5-(2H-benzotriazol-2-yl)-4-hydroxyphenyl] propionate; a UV absorber based on cyanoacrylate such as 2'-ethylhexyl 2-cyano-3,3-diphenylacrylate and ethyl 2-cyano-3,3-diphenylacrylate; a UV absorber based on hindered amine such as bis(2,2,6,6-tetramethyl-4-piperidyl) sebacate, bis(2,2,6,6-tetramethyl-4-piperidyl) succinate and bis(1,2,2,6,6-pentamethyl-4-piperidyl) 2-(3,5-di-t-butyl)malonate; or 1,8-dihydroxy-2-acetyl-3-methyl-6-methoxynaphthalene may be exemplified.

As the fluorescent brightener, for example, 4,4'-bis[2-anilino-4-(2-hydroxyethyl)amino-1,3,5-triazinyl-6-amino] stilbene-2,2'-disulfonic acid disodium salt, 4,4'-bis[2-anilino-4-bis(hydroxyethyl)amino-1,3,5-triazinyl-6-amino] stilbene-2,2'-disulfonic acid disodium salt, 4,4'-bis[2-anilino-4-bis(hydroxypropyl)amino-1,3,5-triazinyl-6-amino]stilbene-2,2'-disulfonic acid disodium salt, 4,4'-bis[2-methoxy-4-(2-hydroxyethyl)amino-1,3,5-triazinyl-6-amino] stilbene-2,2'-disulfonic acid disodium salt, 4,4'-bis[2-methoxy-4-(2-hydroxypropyl)amino-1,3,5-triazinyl-6-amino]stilbene-2,2'-disulfonic acid disodium salt, 4,4'-bis[2-m-sulfoanilino-4-bis(hydroxyethyl)amino-, 3,5-triazinyl-6-amino]stilbene-2,2'-disulfonic acid disodium salt, 4-[2-p-sulfoanilino-4-bis(hydroxyethyl)amino-1,3,5-triazinyl-6-amino]-4'-[2-m-sulfoanilino-4-bis(hydroxyethyl)amino-1,3,5-triazinyl-6-amino]stilbene-2,2'-disulfonic acid tetrasodium salt, 4,4'-bis[2-p-sulfoanilino-4-bis(hydroxyethyl)amino-1,3,5-triazinyl-6-amino]stilbene-2,2'-disulfonic acid tetrasodium salt, 4,4'-bis[2-(2,5-disulfoanilino)-4-phenoxyamino-1,3,5-triazinyl-6-amino]stilbene-2,2'-disulfonic acid hexasodium salt 4,4'-bis[2-(2,5-disulfoanilino)-4-(p-methoxycarbonylphenoxy)amino-1,3,5-triazinyl-6-amino]stilbene-2,2'-disulfonic acid hexasodium salt, 4,4'-bis[2-(p-sulfophenoxy)-4-bis(hydroxyethyl)amino-1,3,5-triazinyl-6-amino]stilbene-2,2'-disulfonic acid hexasodium salt, 4,4'-bis[2-(2,5-disulfoanilino)-4-formalinylamino-1,3,5-triazinyl-6-amino]stilbene-2,2'-disulfonic acid hexasodium salt, or 4,4'-bis[2-(2,5-disulfoanilino)-4-bis(hydroxyethyl)amino-1,3,5-triazinyl-6-amino]stilbene-2,2'-disulfonic acid hexasodium salt may be exemplified.

(Recording Sheet)

The recording sheet of the present invention is a recording sheet having a recording material layer formed of any one of recording materials mentioned above.

In the recording sheet of the present invention, a compound represented by formula (I) is contained in a color developing layer containing a color former and a color-developing agent.

In the recording sheet of the present invention, as a compound represented by formula (I), the same as exemplified above as the Component (B) may be exemplified. Among them, at least one selected from 4,4'-diaminodiphenyl sulfone and 3,3'-diaminodiphenyl sulfone is preferred, and 4,4'-diaminodiphenyl sulfone is particularly preferred.

As the recording sheet of the present invention, a thermal recording paper, a pressure-sensitive copying paper or the like may be exemplified and preferably a thermal recording paper may be mentioned. In the case where the recording sheet of the present invention is used as a thermal recording paper, the recording sheet may be used in the same manner as known in the art. For example, a thermal recording paper may be produced by dispersing fine particles of a compound represented by formula (I) in an aqueous solution of a water-soluble binder such as polyvinyl alcohol and cellulose to prepare a suspension solution, blending suspension solutions separately dispersing fine particles of a color former and color-developing agent with the suspension solution obtained above, applying the mixture onto a support made of e.g., paper, and drying the support.

As the support to be used in the recording sheet of the present invention, paper, synthetic paper, recycled paper such as waste-paper pulp, film, plastic film, foamed plastic film, nonwoven fabric conventionally known or the like may be used. These may be used in combination as a support. Among them, paper is preferably used as a support. The thickness of the support, which is not particularly limited, is usually about 1 to 500 μm.

In the case where paper is used as a support, a dispersion solution containing a color former dispersion solution, a color-developing agent dispersion solution, a sensitizer dispersion solution and a filler dispersion solution may be directly applied to the paper; however, a dispersion solution for an undercoat layer is applied in advance and dried, and thereafter, the aforementioned dispersion solution may be applied. Preferably, the dispersion solution for an undercoat layer is applied, and then, the aforementioned dispersion solution is applied. This is because good color-developing sensitivity is obtained.

The dispersion solution for an undercoat layer is used in order to improve the surface smoothness of a support and particularly not limited; however, a filler, a dispersant and water are preferably contained. Specifically, as the filler, e.g., calcined kaolin or calcium carbonate is preferable. As the dispersant, e.g., polyvinyl alcohol is preferable.

When a recording material layer is formed on a support, a method of applying a dispersion solution containing a dye dispersion solution, a color-developing agent dispersion solution, a sensitizer dispersion solution and a filler dispersion solution to the support and drying the support is preferable. Other than this, a method of applying the dispersion solution by e.g., spraying followed by drying and a method of soaking a support in a dispersion solution for a predetermined time, followed by drying or the like may be exemplified. For applying the dispersion solution, a hand coating method, a size press coater method, a roll coater method, an air knife coater method, a blend coater method, a blow coater method, a curtain coater method, a comma direct method, a gravure direct method, a gravure reverse method, a reverse roll coater method or the like may be exemplified. The application amount, which varies depending upon the concentration of a recording material dispersion solution, is usually 0.1 to 100 g/m$^2$ and preferably 1 to 20 g/m$^2$ on a dry-mass basis.

EXAMPLES

Now, the recording material of the present invention will be more specifically described by way of Examples; however, the present invention is not limited merely to these.

Preparation and Test of Thermal Recording Paper

1) Preparation of Thermal Recording Paper

Example 1

| Dye dispersion solution (Solution A) | |
|---|---|
| 3-di-n-Butylamino-6-methyl-7-anilinofluoran | 16 parts |
| 10% Aqueous polyvinyl alcohol solution | 84 parts |

-continued

| Color-developing agent dispersion solution (Solution B) | |
|---|---|
| PF-201 | 16 parts |
| 10% Aqueous polyvinyl alcohol solution | 84 parts |
| **Filler dispersion solution (Solution C)** | |
| Calcium carbonate | 27.8 parts |
| 10% Aqueous polyvinyl alcohol solution | 26.2 parts |
| Water | 71 parts |
| **Additive dispersion solution (Solution D1)** | |
| 3,3'-diaminodiphenyl sulfone | 16 parts |
| 10% Aqueous polyvinyl alcohol solution | 84 parts |

("parts" represents "parts by mass")

Each mixture having the composition of the solutions A to D1 was sufficiently ground with a sand grinder to prepare dispersion solutions of the components of the solutions A to D1.

1 part by mass of the solution A, 2 parts by mass of the solution B, 3 parts by mass of the solution C, and 1 part by mass of the solution D1 were mixed to prepare a coating solution for a color developing layer. Subsequently, the coating solution for a color developing layer was applied on the white paper-sheet by use of a wire rod and dried, and then calendering treatment was applied to prepare a thermal recording paper (the coating solution for a color developing layer: about 5.5 g/m$^2$ on a dry-mass basis).

Example 2

| Additive dispersion solution (Solution D2) | |
|---|---|
| 4,4'-diaminodiphenyl sulfone | 16 parts |
| 10% Aqueous polyvinyl alcohol solution | 84 parts |

("parts" represents "parts by mass")

A thermal recording paper was prepared in the same manner as in Example 1 except that 1 part by mass of the solution D1 was replaced by 1 part by mass of the solution D2.

Comparative Example 1

| Sensitizer dispersion solution (Solution E) | |
|---|---|
| EGPE | 16 parts |
| 10% Aqueous polyvinyl alcohol solution | 84 parts |

("parts" represents "parts by mass")

A thermal recording paper was prepared in the same manner as in Example 1 except that 1 part by mass of the solution D1 was replaced by 1 part by mass of the solution E.

2) Image Storage Stability Test

With respect to individual evaluation samples, the colored images were subjected to a storage stability test in the following conditions. The results were shown in Table 1.

[Before Test]

Each thermal recording paper was partly cut out and color was developed by use of a thermo-sensitive paper color development test machine (trade name: TH-PMH type, manufactured by OHKURA-DENKI) at a printing voltage of 17 V and a pulse width of 1.8 ms. The density of colored image was measured by a spectrophotometer (SpectroeyeLT, manufactured by X-Rite, Inc.).

[Heat Resistance Test]

Each thermal recording paper was partly cut out and saturated color development was carried out in the same manner as before the test. The paper sample was stored in an incubator (trade name: DK-400, manufactured by YAMATO) of 80° C., 90° C. or 100° C. for 24 hours. After the test, the optical density thereof was measured by a spectrophotometer (SpectroeyeLT, manufactured by X-Rite, Inc.).

[Plasticizer Resistance Test]

Each thermal recording paper was partly cut out and saturated color development was carried out in the same manner as before the test. Subsequently, a vinyl-chloride wrap film (one including a plasticizer) was allowed to adhere to the color developing side and the back side of each paper sample and stored as they were at 40° C. for four hours. Thereafter, the density of colored image was measured by a spectrophotometer (SpectroeyeLT, manufactured by X-Rite, Inc.).

[Oil Resistance Test]

Each thermal recording paper was partly cut out and saturated color development was carried out in the same manner as before the test. Subsequently, the paper was immersed in salad oil, and the density of colored image after one hour at room temperature was measured by a spectrophotometer (SpectroeyeLT, manufactured by X-Rite, Inc.).

TABLE 1

| Evaluation sample | Before test | Heat resistance 90° C. | Heat resistance 100° C. | Plasticizer resistance | Oil resistance |
|---|---|---|---|---|---|
| Example 1 | 1.37 | 1.35 | 1.24 | 1.15 | 1.38 |
| Example 2 | 1.38 | 1.30 | 1.24 | 1.20 | 1.32 |
| Comparative Example 1 | 1.31 | 1.15 | 0.98 | 1.01 | 1.18 |

From the results of Table 1, it was found that a combination with 3,3'-diaminodiphenyl sulfone or 4,4'-diaminodiphenyl sulfone provided excellent storage stability of colored images.

The invention claimed is:

1. A recording material comprising (A) at least one color former, (B) at least one compound selected from the group consisting of compounds represented by the following formula (I):

(I)

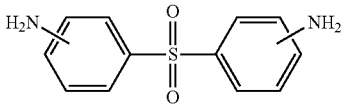

and (C) at least one compound selected from the group consisting of compounds represented by the following formula (II):

(II)

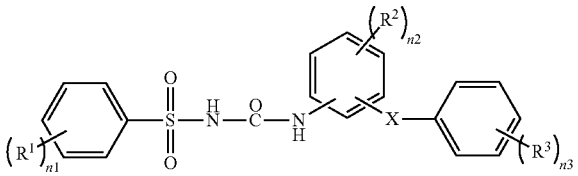

wherein $R^1$ to $R^3$ each represent a halogen atom, a nitro group, a $C_1$ to $C_6$ alkyl group, a $C_1$ to $C_6$ alkoxy group, a $C_2$ to $C_6$ alkenyl group or a $C_1$ to $C_6$ haloalkyl group, n1 and n3 each independently represent any integer of 0 to 5, n2 represents any integer of 0 to 4, and X represents —$SO_2$—O— or —O—$SO_2$—, wherein the recording material does not comprise N-(2-(3-phenylureido)phenyl)benzenesulfonamide.

2. The recording material according to claim 1, wherein the compound represented by the above formula (I) is at least one compound selected from 4,4'-diaminodiphenyl sulfone and 3,3'-diaminodiphenyl sulfone.

3. The recording material according to claim 1, wherein the compound represented by the above formula (II) is a compound represented by the following formula (III):

(III)

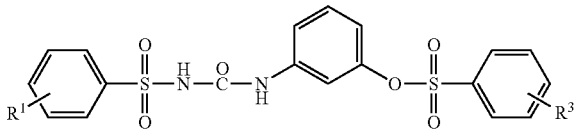

wherein $R^1$ and $R^3$ are the same as $R^1$ and $R^3$ in formula (II).

4. The recording material according to claim 3, wherein the compound represented by the above formula (III) is N-(p-toluenesulfonyl)-N'-(3-p-toluenesulfonyloxyphenyl) urea.

5. The recording material according to claim 1, wherein the color former is a fluoran-based dye.

6. A recording sheet having a recording material layer formed from the recording material according to claim 1 on a support.

* * * * *